US008202405B2

(12) United States Patent
Meneghini et al.

(10) Patent No.: US 8,202,405 B2
(45) Date of Patent: Jun. 19, 2012

(54) END-BOX FOR MERCURY CATHODE ALKALI CHLORIDE ELECTROLYSIS CELL

(75) Inventors: Giovanni Meneghini, Milan (IT); Raffaello Bertin, Vignole Borbera (IT)

(73) Assignee: Industrie de Nora S.p.A., Milan (IT)

( * ) Notice: Subject to any disclaimer, the term of this patent is extended or adjusted under 35 U.S.C. 154(b) by 744 days.

(21) Appl. No.: 12/194,938

(22) Filed: Aug. 20, 2008

(65) Prior Publication Data

US 2008/0308414 A1 Dec. 18, 2008

(30) Foreign Application Priority Data

Feb. 21, 2006 (ID) ..... MI2006A000309

(51) Int. Cl.

| | |
|---|---|
| ***B23H 11/00*** | (2006.01) |
| ***C25B 9/00*** | (2006.01) |
| ***C25C 7/00*** | (2006.01) |
| ***C25D 17/00*** | (2006.01) |
| ***C25F 7/00*** | (2006.01) |

(52) U.S. Cl. ..... 204/275.1; 205/477; 205/556

(58) Field of Classification Search ..... None
See application file for complete search history.

(56) References Cited

U.S. PATENT DOCUMENTS

| | | | | |
|---|---|---|---|---|
| 3,835,002 | A | 9/1974 | Williams et al. | |
| 4,003,415 | A * | 1/1977 | Lasater | 141/59 |
| 4,152,237 | A | 5/1979 | McAllister et al. | |
| 4,440,614 | A | 4/1984 | Reynolds et al. | |
| 6,200,437 | B1 | 3/2001 | Clasen et al. | |
| 2007/0068825 | A1 * | 3/2007 | Oldani et al. | 205/359 |
| 2007/0251888 | A1 * | 11/2007 | Matula | 210/752 |

FOREIGN PATENT DOCUMENTS

| | | |
|---|---|---|
| DE | 1771587 A1 | 12/1971 |
| DE | 8011933 U1 | 7/1980 |

OTHER PUBLICATIONS

International Search Report for Application PCT/EP2007/051576 Dated Nov. 7, 2007.

* cited by examiner

*Primary Examiner* — Luan Van
*Assistant Examiner* — Ibrahime A Abraham
(74) *Attorney, Agent, or Firm* — Eschweiler & Associates, LLC

(57) ABSTRACT

There is disclosed an inlet and outlet end-box design for mercury cathode chlor-alkali electrolysis cells of extended lifetime, comprising a composite mechanical structure consisting of a carbon steel bottom entirely supporting the mechanical solicitations, a plastic cover, and a hydraulic head device for washing the mercury and the amalgam. The device is partially extractable thereby allowing the withdrawal of foreign materials accumulated during operation with no need for opening the end-boxes.

12 Claims, 3 Drawing Sheets

END-BOX FOR MERCURY CATHODE ALKALI CHLORIDE ELECTROLYSIS CELL

CROSS-REFERENCE TO RELATED APPLICATION

This application is a continuation of PCT/EP2007/051576, filed Feb. 19, 2007, that claims the benefit of the priority date of Italian Patent Application No. MI 2006A000309, filed on Feb. 21, 2006, the contents of which are herein incorporated by reference in their entirety.

BACKGROUND

The production of chlorine by electrolysis of alkali chloride solutions, with particular reference to sodium chloride and potassium chloride (hereinafter "brine") is currently carried out according to three different processes, namely, the ion-exchange membrane process, the porous diaphragm process, and the mercury cathode process. The latter type, based on a long-known technology, has experienced a continuous improvement in the cell structure (Ullmann's Encyclopaedia of Industrial Chemistry, VCH, Vol. A6, pag. 416) essentially directed to decreasing the electric energy consumption and lessening the release of mercury into the environment.

The problem of reducing the energy consumption was tackled with success by replacing the original graphite anodes with titanium anodes activated with a particularly effective coating based on oxides of platinum group metals. The activated titanium anodes are also characterised by a long operative lifetime allowing a substantial reduction in the amount of cell shut-downs which were quite frequent in the case of the corrodible graphite anode. Since the maintenance shut-down is a crucial operation as regards the mercury release into the environment, the benefit obtained under this standpoint is apparent.

A further mercury leak reduction was also obtained by the routinary use of recrystallised salt which permits minimising the quantity of mercury-polluted muds purged from the brine purification section, although introducing an additional cost. As a consequence of these measures it can be nowadays demonstrated that the mercury release form a well-designed and correctly handled plant amounts to no more than 3 grammes per tonne of product chlorine versus a value of 10 grammes of about ten years ago (Ullmann's Encyclopaedia of Industrial Chemistry, VCH, Vol. A6, page 424). Such an amount could be further reduced if the frequency of maintenance shut-downs was further decreased: for the time being, such frequency is substantially imposed both the need of periodically cleaning or replacing the inlet and outlet cell end-boxes.

The term inlet end-box indicates the section connected to the initial part of the cell body: such section is directed to ensure the uniform non-turbulent brine and mercury admission into the cell body, as necessary to prevent harmful short-circuits. Examples of inlet end-box design can be found in the prior art.

In accordance with prior art techniques, end-boxes are made of carbon steel lined with various types of synthetic or natural rubbers, usually vulcanised by means of a suitable final thermal treatment in an autoclave.

With the design currently used for the inlet and outlet end-boxes, the accumulation of foreign material, —for instance powders of oxides or other insoluble products, salt scales and the so-called mercury butters, takes place in correspondence of the dead zones, with negative effects on the regularity of the mercury and brine flows and the relatively quick deterioration of the lining as a consequence of the combination of the aggressiveness of fluids, in particular chlorine, with the temperature which may easily reach peaks above 100° C. A further source of deterioration is given by the progressive embrittlement which turns the coating rather sensible to the start-up and shut-down thermal transients. All this forces the operators to carry out periodic shut-downs to proceed with the end-box replacement or with difficult operations of manual cleaning, during which the mercury vapour release in the working environment is practically unavoidable. The replacement in its turn introduces an additional problem which makes this expensive operation even more onerous since the vulcanised rubber lining of the disassembled end-box contains non negligible amounts of mercury and highly toxic products such as dioxins and furanic compounds generated by reaction with chlorine, entailing a remarkable cost for their disposal.

To overcome these difficulties, several types of lining provided with higher chemical inertia and applied with different procedures were proposed. In one example, the use of fluorinated polymers such as polyvinylidenfluoride (PVDF), polychlorotrifluoroethylene (CTFE) and tetrafluoroethylene-hexafluoropropylene (FEP) copolymer is disclosed.

The utilisation of the application procedures of the prior art can, for instance be practiced for lining the sidewalls of the cell body, while this is practically impossible for the end-boxes due to their very complicated structure involving the presence of several edges.

An innovation which found a good user acceptance consists of inlet and outlet end-boxes integrally made of a plastic material optionally reinforced with glass, Kevlar® or carbon fibres. One interesting polymer in this regard is polycyclopentadiene, commercialised for example by BF Goodrich under the trade-mark Telene® and characterised by high chemical resistance to chlorine even at high temperature and by the advantage of not generating noxious chlorinated products as occurs with the various rubber types of common industrial application. The drawback of this solution (characterised by operative lifetimes around 6-7 years, while the duration of the rubber linings does not exceed 3 or 4 years) is associated to the operative temperatures which, as mentioned above, may also exceed 100° C. In these conditions the mechanical characteristics of the polymers, even of reinforced type, are rather poor and on the other hand the mechanical solicitations due both to the weight of mercury and brine contained in the end-boxes during operation and to the thermal expansion are high: it follows that, in order to prevent harmful deformations and in the worst of cases hazardous fissures, the end-boxes made of polymer material must be suitably overdimensioned in terms of thickness and also designed so as to incorporate adequate reinforcing elements with an associated complexity of the moulds. The obvious consequence is represented by a remarkable cost, which up to now has limited their successful commercialisation.

The invention is directed to overcome the above limitations of the mercury cathode cell inlet and outlet end-boxes of the prior art.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, the invention comprises inlet and outlet end-boxes for a mercury cathode electrolysis cell characterised by a superior operative lifetime with respect to the end-boxes of the prior art. The inlet and outlet end-boxes allowing the periodic elimination of accumulated impurities with no need for opening the same, with consequent elimination of the mercury vapour release typical of the cleaning operations carried out on the cells equipped with end-boxes of the prior art.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

BRIEF DESCRIPTION OF THE DRAWING FIGURES

For the sake of facilitating the understanding thereof, the invention will be described making reference to the following drawings having a merely exemplifying scope:

DESCRIPTION

Figure 1:
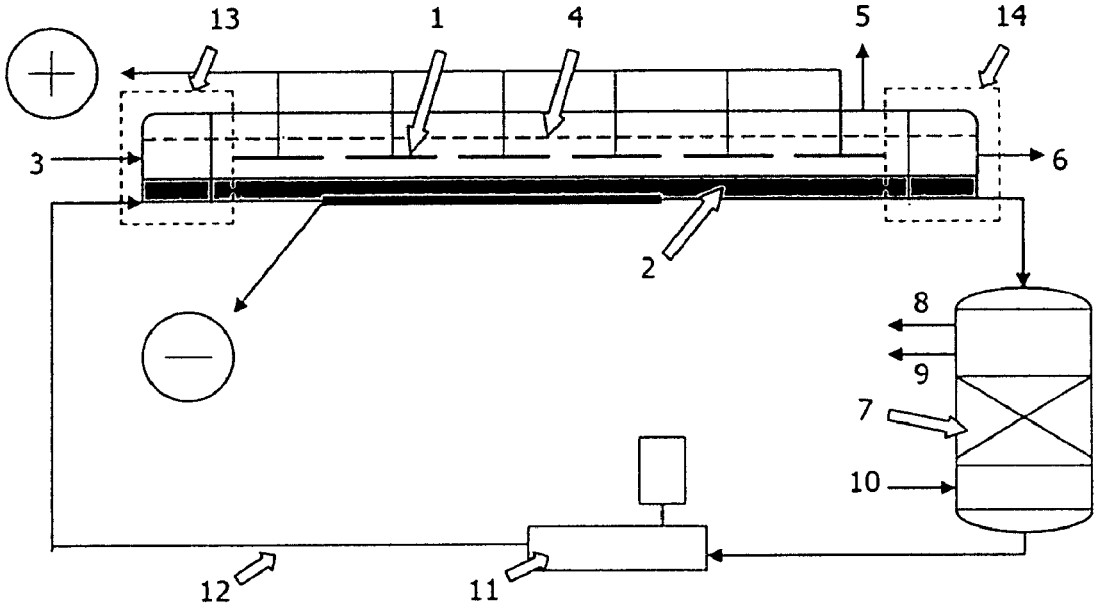
FIG. 1 illustrates a schematic representation of the longitudinal section of a mercury cathode electrolysis cell.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details.

One or more implementations of the invention are hereinafter illustrated and described. However, it will be appreciated by those skilled in the art that the invention is not limited to the exemplary implementations illustrated and described hereinafter.

As it will be evident to one skilled in the art, the characteristic elements of the end-box are common either for its use as the inlet or as the outlet end-box of a mercury cathode electrolytic cell.

The inlet and outlet end-boxes are provided with devices allowing to carry out the mercury and amalgam washing by means of an adequate contact with demineralised water which deprives them respectively of the caustics and of the brine dragged in the relative fluids during the process.

In one embodiment, such devices are in form of cylindrical tubes or parallelepipeds made of titanium or of alkali and chlorine-resistant polymer material and can be externally handled.

In another embodiment, the end-box structure is a composite one, comprising an unlined carbon steel bottom and a cover of polymer material, wherein the carbon steel bottom entirely supports the mechanical solicitations and the cover of polymer material has the sole function of containing the process fluids.

The cover of polymer material is preferably produced by moulding and has a reduced thickness, which makes it economically competitive compared to the end-boxes made of either rubber lined-carbon steel or polymer materials.

The longitudinal section of FIG. 1 is relative to a mercury cathode cell comprising as known the following main components: planar anodes 1 connected to the positive pole of a current rectifier (not shown in the figure) made of titanium provided with an electrocatalytic film for chlorine evolution based on oxides of platinum group metals as known in the art, outlet nozzle for the product chlorine 5, mobile film of mercury 2 flowing on the cell bottom connected to the negative pole of the rectifier proceeding from the inlet end-box 13 to the outlet end-box 14 by virtue of the cell inclination (not shown) with respect to the horizontal plane, feed nozzle 3 for the brine flowing along the cell with formation of a level 4 and exiting from nozzle 6, amalgam decomposer 7 in which the amalgam produced by electrolysis is reacted with demineralised water 10 on a filling formed by fragments of activated graphite with formation of hydrogen 8 and caustic alkali 9, recycle pump 11 of mercury 12.

Figure 2:
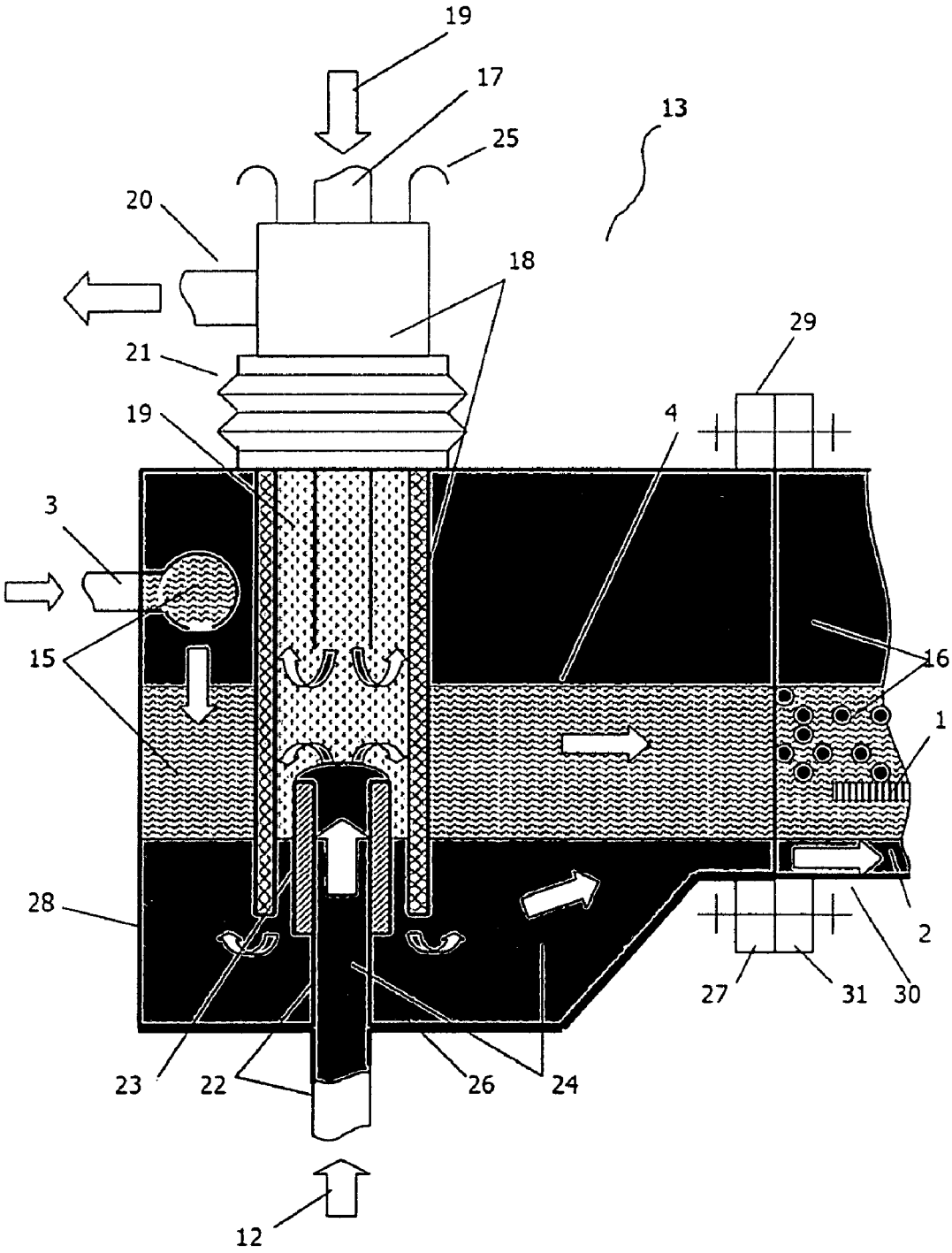
FIG. 2 illustrates a side-view of a partial longitudinal section of an embodiment of cell inlet end-box according to the invention.

FIG. 2 illustrates a side-view of a partial schematic longitudinal section of an embodiment of the inlet end-box 13 of FIG. 1 comprising a mercury washing device wherein the arrows indicate the flow directions of the various process fluids (brine, mercury, water, chlorine).

Brine 15 is fed through nozzle 3 with formation of an internal level 4. The nozzle is connected to an internal distributor formed, in the illustrated embodiment, by a horizontal pipe perforated along the lower generatrix and made of titanium or inert polymer material, or example, polypropylene, polyvinylchloride or fluorinated polymers. It is evident for one skilled in the art that other forms may be employed, for instance, overflow devices secured to the end-box vertical wall in correspondence of the nozzle attachment. In the brine flowing in the cell body 30 are immersed the anodes 1 (a fragment whereof is shown in the figure) on whose surface takes place the evolution of chlorine 16 in the form of bubbles rising up to the brine level 4 and forming a chlorine gas volume comprised between the brine level and the cell upper surface. The recycled mercury 12 coming from the amalgam decomposer is fed to the inlet end-box through the nozzle or duct 22 whose terminal part constitutes the injection point of mercury inside the end-box. In its upper part, the nozzle 22 is optionally provided with a ferrule 23 whose position is adjustable by simple rotation allowing to precisely and accurately predetermine the position of the mercury injection point.

The end-box further comprises an internal duct 17 and an external duct 18 extending in the end-box interior. The duct 17 is used for feeding water 19, preferably demineralised water, until reaching the proximity of mercury surface 24. The external duct 18 has a terminal part immersed in the mercury 24 hence acting as hydraulic head such that the water, flowing along duct 17, once reaching the proximity of the mercury surface is maintained separated from the brine and can only be directed to the gap between external surface of duct 17 and internal surface of duct 18 until reaching the discharge nozzle 20. The adjustment both of the gap between injection point of mercury and level thereof inside the end-box, and of the flow-rate, and optionally the temperature of water 19 allows achieving an advantageous operative flexibility according to three possible conditions summarised as follows:

- dry operation (zero water flow-rate and mercury injection point at the same level of its surface in the end-box interior)

washing only directed to withdraw the caustic residues dragged by mercury coming from the amalgam decomposer and not eliminated by optional external devices (supply of a suitable amount of water 19 with mercury injection point slightly above its surface in the end-box interior)

washing directed to withdraw the caustic alkali residues dragged by mercury coming from the amalgam decomposer with simultaneous cooling of mercury (supply of water 19 with flow-rate indicatively higher than required for a simple washing and with the gap between mercury injection point and its level in the end-box interior higher than the case of simple washing, for instance between 5 and 10 cm).

The first operative condition corresponds to the common practice of the industrial plants. By virtue of the dry operation, the mercury does not undergo a significant temperature reduction and therefore the materials employed for the end-box manufacturing are subject to harsh operative conditions. Moreover, for failing to eliminate the caustic alkali drags, a sensible loss of efficiency in chlorine production is experienced due to the formation of hypochlorite and to the parasitic evolution of oxygen.

The aforementioned loss of efficiency is completely avoided with the second operative condition wherein, with a suitable water flow-rate, the complete elimination of caustic alkali residues, withdrawn in admixture with water 19 through the discharge nozzle 20, can be obtained. Nevertheless, the inconveniences associated with the high temperature of mercury are left unchanged.

The third operative condition allows achieving both of the targets of caustic alkali residues elimination and mercury temperature control. As regards the latter, the thermal exchange achieved by increasing the gap between mercury injection point and level thereof in the end-box interior allows lowering the end-box operative temperature even at particularly high operative temperatures of the amalgam decomposer, with the apparent advantage of a prolonged end-box lifetime. Since proceeding with the operation the impurities always present in the industrial processes, such as mercury butters, accumulate in the mercury inlet zone hindering the flow, in one embodiment the external duct 18 is partially extractable and the plant operators can periodically lift and lower it, making it slide along its vertical axis by means of handles 25. For this purpose, the duct 18 is advantageously provided with a bellows 21, for instance made of polytetrafluoroethylene totally inert to chlorine, ensuring the sealing independently from the position of the duct with respect to the end-box, thereby preventing the product chlorine to be released into the environment. Following this simple operation the duct 18 loses the function of hydraulic head and the foreign material accumulated in its interior is removed by the water 19 and brine 15 flows which eventually mix. There is thus formed a suspension which is extracted from the cell through the outlet nozzle 6 and sent to the external treatment systems. Once completing the cleaning procedure, the hydraulic head is restored together with the separation between brine 15 and water 19. In the prior art cells, the cleaning operations of foreign materials, at any rate accumulated in the inlet end-boxes, is carried out manually through suitable hatchways in the end-boxes (not shown in the drawings) which must necessarily be opened. As is evident, this is a cumbersome intervention entailing a detrimental dispersion of chlorine and mercury vapours into the working environment.

Figure 3:
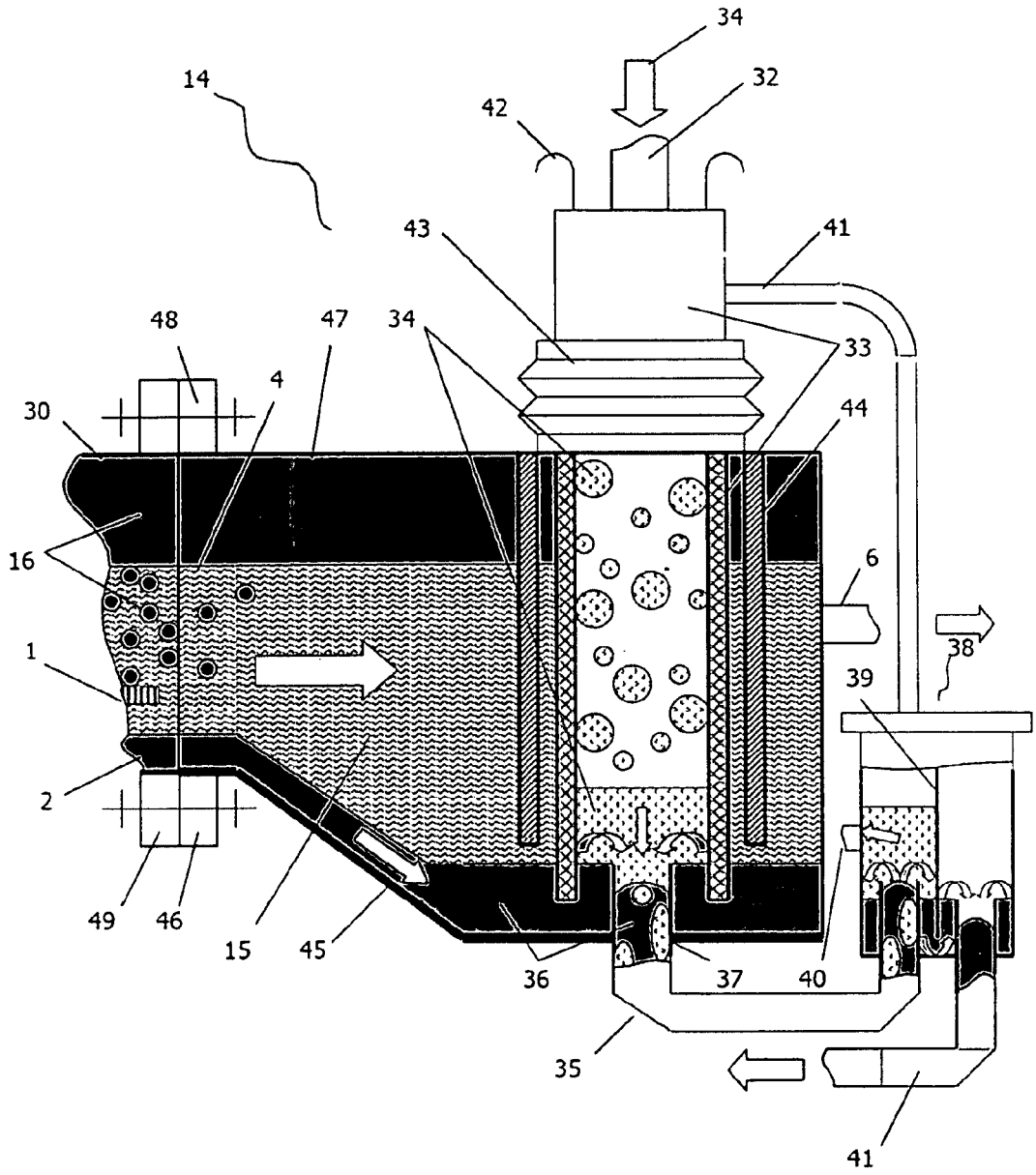
FIG. 3 illustrates a side-view of a partial longitudinal section of an embodiment of cell outlet end-box according to the invention.

The characterising elements just described for the inlet end-boxes are advantageously applicable to the outlet end-boxes as well, where FIG. 3 shows a side-view of a partial schematic longitudinal section with the arrows indicating the flow directions of the various process fluids (brine, mercury, water, chlorine), the components in common with the previous figures being identified with the same reference numerals. The brine 15 coming from the cell body 30 is discharged through nozzle 6. In the brine are immersed the anodes 1 (a fragment whereof is shown in the figure) on whose surface the evolution of chlorine 16 takes place in form of bubbles rising up to the level 4 of brine forming a volume of gaseous chlorine comprised between the level of brine and the cell upper surface. The amalgam 36 formed during the passage of mercury across the cell body 30 is collected on the cell bottom and then discharged through the nozzle or duct 35.

The end-box is provided with a device for washing the amalgam with water 34, preferably demineralised water, comprising an internal injection duct 32 and an external duct 33 whose lower terminal part is immersed in the volume of amalgam contained in the end-box. A hydraulic head is thus formed, preventing the water 34 to mix with the brine 15. As opposed to what is disclosed for the two equivalent ducts 17 and 18 of the inlet end-box, the duct 33 is not provided with a discharge nozzle and consequently the water 34 can be discharged only through the amalgam discharge nozzle 35. The mixture of amalgam and water droplets 37 is sent to a separator 38 provided with internal septum 39 whose extremity is immersed in the amalgam. The separated water is discharged through nozzle 40, while the amalgam is fed to the amalgam decomposer (7 in FIG. 1) through the nozzle or duct 41. This system allows performing an effective washing of the amalgam since all the dragged brine is dissolved into the water 34 and eliminated through the nozzle 40. Furthermore, by immersing an adequate portion of septum 39 in the amalgam, any possible passage of water 34 into the amalgam sent to the amalgam decomposer is prevented, thereby reducing the chloride content in the product caustic soda to zero. The internal pressure of the separator 38 is adjusted though the balancing tube 41 connected to duct 33.

As described for the inlet end-box, the impurities accumulated during operation inside the duct 33 are periodically eliminated by externally lifting and lowering the duct 33, partially extractable through handles 42, several times. For this purpose, the duct 33 is provided with a bellows 43, made for instance of polytetrafluoroethylene completely inert to chlorine, which ensures the sealing independently from the position of the duct with respect to the end-box, hence preventing the product chlorine to be released into the external environment. The break-down of the hydraulic head induced by the sliding of the duct 33 determines the dispersion of the impurities accumulated as suspension in the flow of mixed water and brine leaving the end-box through the outlet nozzle 6. Optionally, the washing system may be completed by a sheath 44, fixed to the upper wall of the end-box, which effects the scraping of the possible scales adhering to the external surface of duct 33 during the lifting and lowering operation. The advantages of the washing device are not limited to the higher quality of the product caustics but are also extended to the improved working conditions of the operators since in the current practice, the cleaning of the outlet end-boxes is carried out manually, as applies for the inlet end-box, by opening a hatchway with consequent release of chlorine and more importantly of mercury vapours into the environment.

The above illustrated mercury and amalgam washing devices, as well as the nobles or ducts for feeding the mercury and extracting the amalgam may consist of tubes (in this case, ducts 17, 18, 22 and 32, 33, 35, 44 are coaxial) or parallelepipeds. Ducts 17, 18, 33 and 44 are made of titanium or preferably of a polymer material resistant to the aggressive action of chlorine, such as polypropylene, polyvinylchloride and fluorinated polymers, such as polytetrafluoroethylene, polychlorotrifluoroethylene and copolymers thereof.

The inlet and outlet end-boxes of prior art cells are made of a carbon steel framework lined with vulcanised rubber, or of an integral structure of optionally reinforced plastic material, such as for instance polycyclopentadiene, commercialised by BF Goodrich under the trade-mark Telene®. Both solutions are less than satisfactory, the former due to the reduced lifetime, the problems associated with the release of mercury into the environment during the operations of replacement and the disposal costs of mercury-containing exhaust materials and of noxious compounds such as dioxins and furans generated during operation, the latter essentially for the high cost deriving from the high thicknesses and the complex design required to withstand the mechanical solicitations caused by the dilations and by the weight of brine and mercury without undergoing deformations, although the duration and the disposal conditions would in this case be satisfactory.

In order to overcome these problems, the invention provides incorporating the above disclosed adjustable devices for the washing of mercury and amalgam in end-boxes of novel design. According to such design, the end-boxes are characterised by a novel composite structure comprised of two parts, respectively consisting of a carbon steel bottom 26, 45 provided with flange 27, 46 having a thickness suitable for bearing the overall weight, and of a cover (or guard) 28, 47 of optionally reinforced plastic material, for instance the above mentioned Telene®, secured to the bottom by means of a suitable bolting 26, 45 and also so provided with flange 29, 48. When such inlet and outlet composite end-boxes are installed by bolting of the flanges 27, 46 and 29, 48 to the terminal flanges 31, 49 of the cell body 30 the weight of the whole end-box is entirely supported by the steel bottom 26, 45 and, therefore, the mechanic solicitation exerted on the cover of plastic material is totally negligible. This situation allows decreasing the thicknesses of plastic material and simplifying the shape of the cover with consequent substantial reduction of the manufacturing costs.

The composite end-boxes are characterised by a series of advantages, in particular a long operative lifetime guaranteed by the renowned chemical inertia of suitable plastics, by the covering of the carbon steel ensured by mercury during operation and by the cathodic protection conditions established in the transient situation of partial uncovering typical of the shut-downs (indicatively, the duration of the end-boxes according to the invention is estimated to be at least 8 years, to be compared to 3-4 years typical of the conventional rubber-lined end-boxes). A further advantage is represented by the facility of disposal of the worn out covers—since suitably selected plastics are found to be virtually free of mercury and noxious products such as dioxins and furans even after years of operation—and by the substantial reduction of manufacturing costs deriving from the reduced thicknesses required for the covers.

Although the disclosure has been shown and described with respect to one or more embodiments and/or implementations, equivalent alterations and/or modifications will occur to others skilled in the art based upon a reading and understanding of this specification. The disclosure is intended to include all such modifications and alterations and is limited only by the scope of the following claims. In addition, while a particular feature may have been disclosed with respect to only one of several embodiments and/or implementations, such feature may be combined with one or more other features of the other embodiments and/or implementations as may be desired and/or advantageous for any given or particular application. Furthermore, to the extent that the terms "includes", "having", "has", "with", or variants thereof are used in either the detailed description or the claims, such terms are intended to be inclusive in a manner similar to the term "comprising."

The invention claimed is:

1. End box for a mercury cathode cell for alkali chloride brine electrolysis, provided in an operative condition with a brine level and a mercury or amalgam level, comprising a device for contacting the mercury or amalgam with water, the device being formed by an internal duct for feeding the water and an external duct equipped with a bellows and having a first and a second flange secured by bolting to a terminal flange, the external duct being partially extractable and having a lower extremity immersed in the mercury or amalgam, thereby establishing a hydraulic head.

2. The end-box of claim 1, the external duct provided with handles.

3. The end-box of claim 1, comprising inlet nozzles for the water and for mercury and at least an outlet nozzle of said water.

4. The end-box of claim 3, the height of the upper extremity of the mercury inlet nozzle is adjustable with respect to the level of mercury contained in the end-box.

5. The end-box of claim 4, wherein the adjustment of the height is performed by rotating a ferrule.

6. The end-box of claim 1, comprising outlet nozzles for the product amalgam and for the water.

7. The end-box of claim 6, wherein the external duct is inserted in a sheath.

8. The end-box of claim 1, the internal duct, the external duct and the sheath comprising titanium or a polymer material.

9. The end-box of claim 8, the polymer material comprising one or more of polypropylene, polyvinylchloride, fluorinated polymers and copolymers thereof.

10. The end-box of claim 1, comprising a composite structure formed by an unlined carbon steel bottom provided with a first flange and a cover of polymer material provided with a second flange.

11. The end-box of claim 10, the bottom having thickness suitable for supporting the whole weight of the end-box during operation, including the weight of fluids contained therein.

12. Mercury cathode cell for alkali chloride brine electrolysis comprising a cell body provided with terminal flanges, an inlet end-box and an outlet end-box, wherein at least one of the inlet and outlet end-boxes is the end-box of claim 1.

* * * * *

UNITED STATES PATENT AND TRADEMARK OFFICE

CERTIFICATE OF CORRECTION

PATENT NO. : 8,202,405 B2
APPLICATION NO. : 12/194938
DATED : June 19, 2012
INVENTOR(S) : Giovanni Meneghini et al.

It is certified that error appears in the above-identified patent and that said Letters Patent is hereby corrected as shown below:

Title Page,

Please add the priority application of PCT/EP2007/051576 filed on February 19, 2007 to the bibliographic data page.

Signed and Sealed this
Twenty-fourth Day of July, 2012

David J. Kappos

David J. Kappos
*Director of the United States Patent and Trademark Office*